US010418771B2

(12) United States Patent
Fin

(10) Patent No.: US 10,418,771 B2
(45) Date of Patent: Sep. 17, 2019

(54) METHOD AND DEVICE FOR APPLYING AN ELECTRICAL TERMINAL TO ONE OR MORE ELECTRICAL CONDUCTORS, WHETHER INSULATED OR NOT, AND ELECTRICAL TERMINAL SUITABLE FOR THIS PURPOSE

(71) Applicant: Diego Fin, Trissino (IT)

(72) Inventor: Diego Fin, Trissino (IT)

( * ) Notice: Subject to any disclaimer, the term of this patent is extended or adjusted under 35 U.S.C. 154(b) by 282 days.

(21) Appl. No.: 15/126,387

(22) PCT Filed: Mar. 10, 2015

(86) PCT No.: PCT/IB2015/051731
§ 371 (c)(1),
(2) Date: Sep. 15, 2016

(87) PCT Pub. No.: WO2015/140668
PCT Pub. Date: Sep. 24, 2015

(65) Prior Publication Data

US 2017/0085049 A1 Mar. 23, 2017

(30) Foreign Application Priority Data

Mar. 18, 2014 (IT) ..... VI2014A0060

(51) Int. Cl.
*H01R 43/04* (2006.01)
*H01R 43/20* (2006.01)
*H01R 43/048* (2006.01)
*H01R 43/16* (2006.01)

(52) U.S. Cl.
CPC ..... *H01R 43/048* (2013.01); *H01R 43/16* (2013.01); *Y10T 29/49185* (2015.01); *Y10T 29/53209* (2015.01)

(58) Field of Classification Search
CPC ... H01R 43/048; H01R 4/18; Y10T 29/49185; Y10T 29/4919; Y10T 29/49181; Y10T 29/53209; H05B 3/06; B29C 65/02; B29C 67/0044
USPC ..... 29/863, 747, 753, 761, 857, 861, 866, 29/868, 871, 874
See application file for complete search history.

(56) References Cited

U.S. PATENT DOCUMENTS 7,306,495 B2 * 12/2007 Hashimoto ..... H01R 4/185 439/877
9,305,083 B2 * 4/2016 Hu ..... G06F 17/30864

* cited by examiner

*Primary Examiner* — Thiem D Phan
(74) *Attorney, Agent, or Firm* — Robert Lelkes

(57) ABSTRACT

The invention provides a method for applying an electrical terminal to one or more conductors, possibly provided with an external electrical insulation layer, comprising the following steps: placing the end portions of the conductors in a housing portion of the terminal; applying heat and pressure in such a way as to compact and/or join the end portions of the conductors and the housing portion of the electrical terminal and to remove any respective electrical insulation layers at least at the level of the housing portion of the electrical terminal. The application of pressure and heat causes the opposite walls to close on the end portions of the conductors. Said electrical terminal comprises an electrical connection portion that extends from the housing portion. The invention also concerns a device or piece of equipment for the application of an electrical terminal, a metal element and an electrical terminal.

11 Claims, 9 Drawing Sheets

METHOD AND DEVICE FOR APPLYING AN ELECTRICAL TERMINAL TO ONE OR MORE ELECTRICAL CONDUCTORS, WHETHER INSULATED OR NOT, AND ELECTRICAL TERMINAL SUITABLE FOR THIS PURPOSE

TECHNICAL FIELD OF THE PRESENT INVENTION

The present invention concerns the technical field of electrical connections. In particular, the present invention concerns the technical field of electrical connections for electrical windings and/or coils made using insulated conductors, wires or straps, for example used in the case of electric motors, generators or similar products. In greater detail, the present invention concerns a method and a device for applying an electrical terminal to one or more electrical conductors, whether insulated or not, in particular of a winding or coil, as well as an electrical terminal suitable for said purpose.

DESCRIPTION OF THE STATE OF THE ART

In the field of electrical windings, for motors or similar products, in particular in the field of assembly of electric motors or similar products, several methods are known for applying an electrical terminal to the conductors of a winding, wherein the electrical terminal is used to for the electrical connection of the winding to a power source.

Among the methods belonging to the known art, the most common includes the use of a flame to initially burn the insulating enamel and remove it from the conductors of the winding, for a length ranging between 2-3 cm and 10-15 cm according to the diameter of the wire and the number of wires (conductors) that must be joined, wherein "joining" means connecting the conductors to one end of an electrical cable, and wherein an electrical terminal is previously applied to the end of the cable opposite the end to be connected to the conductors. Once the insulating enamel has been removed, the joining operation is performed, melting the metal of the conductors, for example applying or not special brazing pastes to the conductors.

A further alternative method according to the known art includes the mechanical removal of the insulating layer from the conductors through the use of properly shaped cutters and/or abrasive brushes (or even through sandblasting or chemical aggression). Once the enamel has been removed, the connection between conductors and cable is performed, inserting them in a ring or wire terminal and pressing said ring or wire terminal through suitable tools, in such a way as to compact the several components together, meaning the ring or wire terminal and the conductors and the cable inside it.

According to a further method known in the art, a crimp with teeth or projections is used that is crimped on the conductors so that said projections (teeth) cut the insulating enamel and produce the electrical contact between the crimp and the conductors.

All the methods mentioned above are still widely used today, but in addition to them substantially other two methods stand out that combine some of the previous techniques.

The first method is hot crimping, according to which a crimp is still used that is machine-formed or preformed starting from a strap made of a conductor material, usually copper, and that is interposed between two heating elements, wherein the conductors and the cable are introduced in the crimp that is thus pressed and heated through said heating elements, thus obtaining the removal of the enamel from the conductors and the plastic deformation of the crimp itself.

The second method makes use of a tubular element and includes a step of preparation of the conductors during which the conductors are selected, grouped and cut to size. Successively, the cable is joined and the conductors and the cable are inserted in the tubular element. The tubular element, in particular, can be positioned between two heating elements (electrodes) in advance or after the insertion. At this point, the tubular element is pressed and successively heated to obtain results similar to those obtainable through the use of a crimp.

The methods or processes according to the known art described above pose several drawbacks that can be summed up as follows.

In the classic method employing the flame (torch), the main problems are represented by the fact that the operation is manual and therefore involves very long execution times and by the scarce reliability and repeatability of the process, the outcome of which depends exclusively on the ability of the operator.

The method involving the mechanical or chemical removal of the insulation layer is time-demanding and complex, and the insulation layer cannot always be removed uniformly and from the entire surface of the conductor; it is also difficult to remove the insulating layer without cutting or damaging the conductor material. The method furthermore needs successive steps for cutting the conductors to size, inserting them in the conductor together with the cable (if provided) and then proceeding to deform the connector with the aid of special tools or presses, depending on the size. The method is therefore difficult to apply for industrial-scale production.

The main drawback posed by the hot crimping method is due to the fact that exploiting the teeth that are present in the crimp to obtain the electrical contact inevitably means limiting the number of conductors that can be joined in parallel (maximum 2 or 3). In fact, in order to obtain a good contact it is necessary to allow for a sufficient contact surface between the crimp and the conductor, wherein, obviously, this surface decreases as the number of conductors increases, until disappearing completely (in the case of wires placed in the middle). Furthermore, using this method it is particularly difficult to join conductors with different cross sections.

In the case of the hot crimping method, the main problems are due to the scarce flexibility of the crimp and the shape of the crimp itself. In fact, as the crimp is usually obtained by rolling a piece of strap on a round tool, the size of the crimp remains related to the diameter of the tool and in the case of conductors with highly variable cross sections the crimp is not very functional, since in order to increase or decrease its size it is necessary to replace the tool. Common crimps, furthermore, sometimes are scarcely resistant to mechanical stress and tend to open and/or become deformed.

Finally, also the method that makes use of the tubular element is decidedly complex and slow, since very lengthy preliminary operations are needed to prepare the connection, such as cutting the wires, joining the cable, inserting the wires in the connector, positioning the wires between the electrodes, performing the hot crimping cycle.

It is thus one object of the present invention to overcome the drawbacks mentioned above and found in the methods of the known art.

In particular, the aims and objects of the present invention can be summed up as follows.

It is a first and important object of the invention to provide a method that makes it possible to connect one or more insulated conductors (some insulated and some even not insulated) individually, for example of a winding for an electric motor, directly to the point of withdrawal of electric energy that for example, in the case of an electric motor, is represented by the terminal board or strip, eliminating intermediate electrical connection elements, in particular the cable with terminal used in the methods according to the known technique.

In particular, from an electrical point of view, a first object is to reduce the points of accumulation of electrical resistance and possible fragility due to the use of multiple joints between the different conductor elements of the electric circuit deriving in particular from the use of the cable with terminal. In this regard, it should be noted that today the typical circuit is generally constituted as follows: "terminal+cable+winding turn". The present invention is intended to simplify the circuit, limiting its components to "cable terminal+winding turn".

It is a further object of the present invention to propose a method that is inexpensive and easy and rapid to implement and that furthermore can be implemented using equally simple and inexpensive tools and/or devices.

According to the present invention, the objects or aims mentioned and described above are achieved through a method and a device for applying an electrical terminal to a plurality of insulated conductors as respectively specified in claims 1 and 7, as well as through an element and an electrical terminal respectively.

Further advantages will furthermore be obtained through the further embodiments of the present invention defined in the dependent claims.

DESCRIPTION OF THE PRESENT INVENTION

The present invention can be especially and conveniently applied in the field of electrical windings, in particular for electric motors, transformers, generators or similar products. This is, therefore, the reason why examples of application of the teachings of the present invention to the specific case of a winding for electric motors are described and/or mentioned here below.

It should however be noted that the possible applications of the teachings according to the present invention are not limited to the specific case of windings or coils for electric motors or similar products of the type mentioned above.

On the contrary, the present invention can be advantageously applied in all those cases in which it is desirable to electrically connect one or more electrical conductors (of which some may be insulated and others not) to a common source of electric energy.

The present invention is based on the general concept that the disadvantages or drawbacks that are typical of the solutions known in the art can be overcome or at least reduced or minimized through a solution that allows a direct electrical connection to be obtained between a plurality of conductors and the point of withdrawal and/or distribution of electric energy, wherein the term direct electrical connection means a connection through an electrical terminal directly applied to the plurality of conductors. A further consideration on which the present invention is based is related to the use of an electrical terminal that, on one side, makes it possible to obtain a reliable electrical connection with the plurality of conductors by means of simple operations and devices and, on the other side, can be directly connected to the point of withdrawal or distribution of electric energy.

Furthermore, always according to the present invention, this involves the use of an electrical terminal that can be produced in a simple way starting from a strap made of a conductor material, wherein the electrical terminal, if required, can be substantially made at the same time as the electrical connection.

In particular, the present invention includes the use of an electrical terminal having a portion made as a crimp and a portion made as a cable terminal, that is, an electrical terminal that in the portion intended to be used for connection to the plurality of conductors is similar to a crimp and in the opposite portion is similar to a cable terminal, for example of the type comprising an eyelet for connection to an electrical pole.

DESCRIPTION OF THE PRESENT INVENTION

Based on the considerations expressed above, the subject of a first embodiment of the present invention is a method according to claim 1, meaning a method for the application of an electrical terminal to one or more conductors, at least one of said one or more conductors being provided with an external electrical insulation layer, said method comprising the following steps: placing the end portions of said one or more conductors in a housing portion of said terminal; applying heat and pressure in such a way as to compact and/or join said end portions of said one or more conductors and said housing portion of said electrical terminal and to remove the corresponding electrical insulation layers at least at the level of said housing portion of said electrical terminal; wherein said housing portion of said electrical terminal is channel-shaped with cross section substantially in the shape of a U or a V or a similar shape with two opposite walls, wherein by applying pressure and heat it is possible to make said opposite walls close on said end portions of said one or more conductors, and wherein said electrical terminal comprises an electrical connection portion that extends from said housing portion.

Preferably, said electrical connection portion comprises an eyelet.

Even more preferably, said method comprises the formation of said electrical terminal by cutting and/or punching and bending a continuous metal strap.

Said metal strap can also be unwound from a coil.

Still preferably, said housing portion of said electrical terminal is housed in a seat of a supporting element or mould whose shape matches that of said housing portion, in the shape of a U or a V or a similar shape, of said electrical terminal. If required, said method may also comprise the removal of the end portions of said one or more conductors projecting from said portion, in the shape of a U or a V or a similar shape, of said electrical terminal.

The subject of the present invention also includes a device according to claim 7, meaning a device or piece of equipment for applying an electrical terminal to one or more conductors through a method according to the present invention, at least one of said one or more conductors being provided with an external electrical insulation layer, said device comprising: means for housing the end portions of said one or more conductors in a housing portion of said terminal; means for applying heat and pressure in such a way as to compact and/or join said end portions of said one or more conductors and said housing portion of said electric terminal and to remove the respective electrical insulation layers at least at the level of said housing portion of said electrical terminal; wherein said housing portion of said electrical terminal is channel-shaped with cross section substantially in the shape of a U or V or a similar shape with two opposite walls, wherein said electrical terminal comprises an electrical connection portion that extends from said housing portion, and wherein said means for said application of pressure and heat are such that they cause said opposite walls to close on said end portions of said one or more conductors.

According to an alternative embodiment of the invention, said device furthermore comprises means for the formation of said electrical terminal by cutting and/or punching and/or bending a continuous metal strap.

According to a further embodiment of the invention, said device comprises also means for unwinding said continuous metal strap from a coil.

Preferably, said device also comprises a support or mould provided with a seat suited to accommodate said housing portion of said electrical terminal, wherein the shape of said seat matches the shape of said housing portion, in the shape of a U or a V or a similar shape, of said electrical terminal.

According to a further preferred embodiment, also the element or press is provided with a seat or recess.

According to a further preferred embodiment of the invention, the support or mould comprises a first portion and a second portion that are mutually movable with respect to each other so that they can be properly configured during the processing steps.

If required, said device may comprise means for removing the end portions of said one or more conductors that project from said portion, in the shape of a U or a V or a similar shape, of said electrical terminal.

Finally, it is the object of the present invention to provide an element for the formation of an electrical terminal and an electrical terminal, respectively.

Possible further embodiments of the present invention are defined in the dependent claims.

BRIEF DESCRIPTION OF THE DRAWINGS

The present invention is illustrated here below through the description of some embodiments that are represented in the attached drawings. However, it should be noted that the present invention is not limited to the particular embodiments illustrated in the drawings; rather, all those variants or modifications represented and described herein that will appear clear, obvious and immediate to the expert in the art fall within the scope of the present invention. In particular, in the attached drawings.

DETAILED DESCRIPTION OF SOME EMBODIMENTS OF THE PRESENT INVENTION

Figure 1:
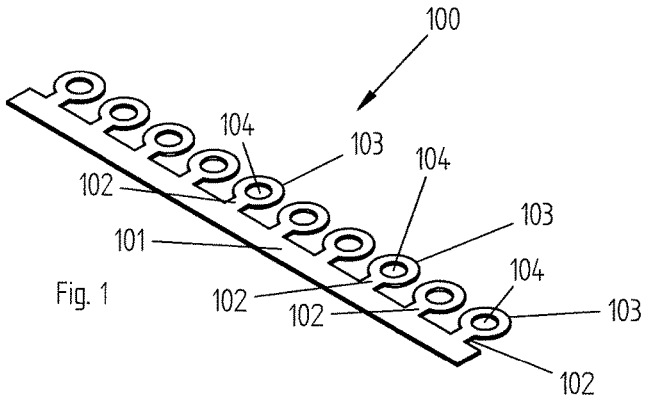
FIGS. 1 and 2 show each an element made of a conductor material for making an electrical terminal according to the present invention.
Figure 2:
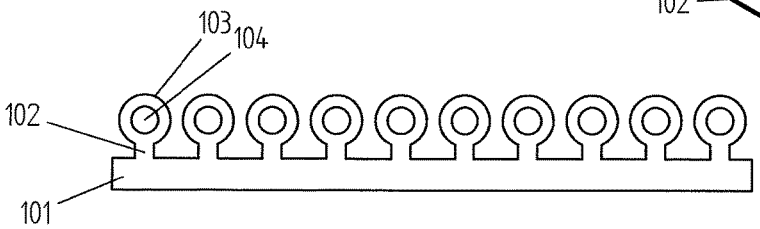

In FIGS. 1 and 2 the reference number 100 identifies an element made of a conductor material, for example copper or a similar material or metal, comprising an elongated body 101 from one side of which portions 102 extend along a direction that is substantially transverse with respect to the direction of extension of the main body 101, each one of said portions 102 ending with a cable terminal, in the case at hand with an eyelet 103 constituted by an annulus that forms a centre through hole 104. As is clear in the following description, the cable terminals are used for connection to a point of withdrawal or distribution of electric energy, for example an electrical pole or terminal suited to be housed in the eyelet 103. Obviously, as an alternative to the eyelet 103 it is possible to use also other solutions, like solutions of the fork type or similar solutions.

The element 100 can represent both the starting element and the intermediate element for making connection terminals according to the present invention that are described in greater detail below. This means that, according to an embodiment, in a method according to the present invention it is possible to use an element 100 as shown in the figures and previously prepared starting from a strap made of a conductor material through cutting, punching, bending and similar operations, or alternatively during the application of the method itself it will be possible to proceed with the processing of a simple metal strap and, again through cutting, punching, bending and similar operations, produce a plurality of electrical terminals according to the present invention, to be used by means of the device and according to the method of the present invention. As a further alternative, according to the present invention it will be possible to use also individual electrical terminals prepared separately. In particular, both the metal strap and the intermediate element 100, if used as starting elements, can be unwound from a coil.

Figure 3:
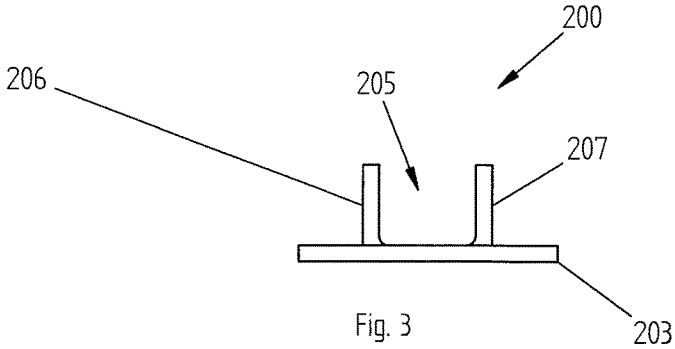
FIGS. 3, 4 and 5 respectively show a side view, a perspective view and a plan view of an electrical terminal according to an embodiment of the present invention.
Figure 5:
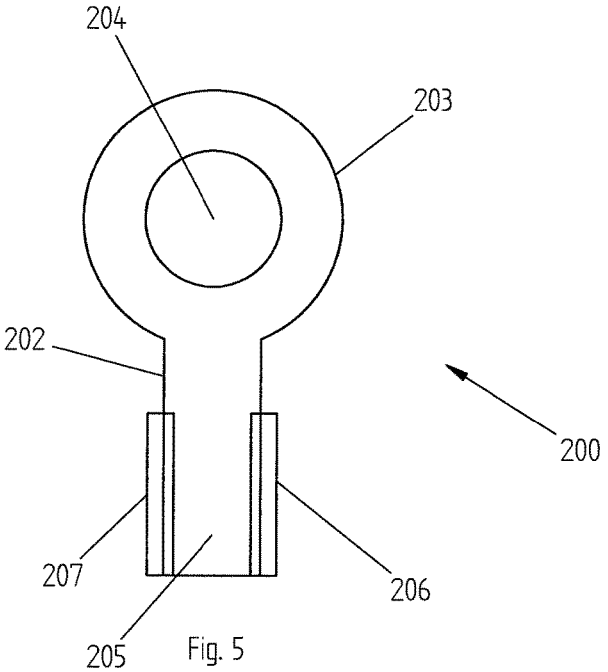
Figure 4:
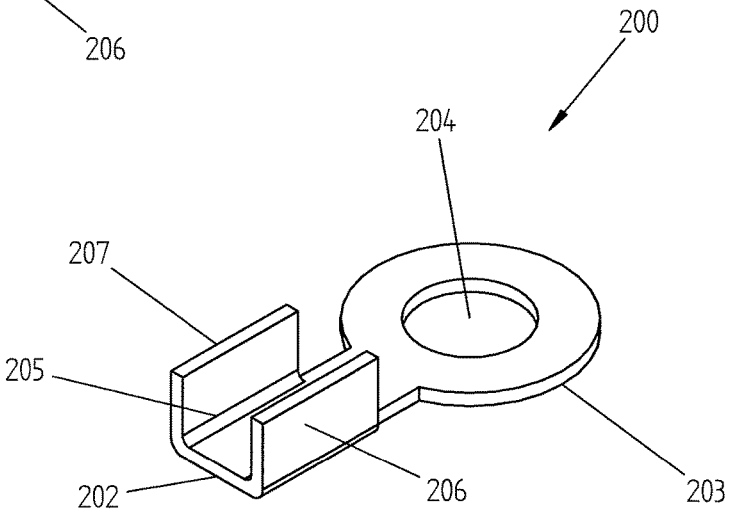

In FIGS. 3 and 4 the reference number 200 identifies an electrical terminal according to an embodiment of the present invention to be applied to one or more insulated or non-insulated conductors (provided with an electrical insulation layer or not), for example the conductors of a winding or a coil of an electric motor.

As previously mentioned, each one of the electrical terminals 200 can be made during the process or method according to the present invention, starting either from a simple metal strap substantially rectangular in shape and possibly wound in a coil, by punching and bending the strap itself, or from an intermediate element 100 as shown in FIGS. 1 and 2 and previously arranged or prepared. In the latter case, the punching, bending and similar operations will be divided in two separate steps, of which one is carried out before the application of the terminals to the electrical conductors and is aimed at obtaining an intermediate element 100 as shown in FIGS. 1 and 2, while the other is performed substantially at the same time as or in any case is part of the method according to the present invention for the application of an electrical terminal to a plurality of conductors and is intended for the actual preparation of electrical terminals 200 of the type shown in Figures from 3 to 5, wherein also the element 100 can be prepared in the form of a coil to be unwound.

According to a further embodiment of the present invention, the electrical terminals can also be prepared separately.

It is clear in Figures from 3 to 5 that the electrical terminal 200 comprises a portion 202 intended to provide both the electrical connection and the mechanical connection with one or more conductors; for this purpose, the portion 202 comprises a channel-shaped end with cross section substantially in the shape of a U (or also a V or a similar shape, see the description provided below), that is, provided with two opposite walls 206 and 207 that define an inner space 205 suited to house (see the description provided below) the end portions of said one or more electrical conductors to be connected. The end of the terminal 200 opposite the U-shaped end comprises an eyelet 203 with a centre housing hole 204 and is therefore suitable for the connection of the terminal 200, and therefore of said one or more conductors, to an electrical pole or terminal through the terminal 200. It can thus be understood that the electrical terminal 200 is suited to be used for the direct connection of one or more conductors, for example to a point of withdrawal or distribution of electric energy, in particular to a pole or terminal of a terminal board or strip. Obviously, as already explained, as an alternative to the eyelet 203 it is possible to use different solutions from those known to the expert in the art, for example solutions of the fork type or similar solutions. The special characteristic of the terminal 200, then, lies in that it comprises a portion of the crimp type to be crimped or in any case connected to a plurality of electrical conductors, together with a portion for connection to an electrical pole or terminal.

Figures from 6 to 8 schematically show a device 300 according to an embodiment of the present invention, as well as a first step of the method according to the present invention for the application of an electrical terminal 200 of the type previously described with reference to Figures from 3 to 5 to one or more conductors, insulated or not. The device 300 comprises, in particular, two opposite parts, meaning an element or press 301 with a projection 302 and a support or mould 303 with a recess or seat whose shape matches the shape of the projection 302, wherein at least one of the components 301 and 303 is movable along the directions indicated by the double arrow so that the element 301 and the mould or support 303 can be moved near each other until the projection 302 is inserted in the seat or recess 304.

Figure 6:
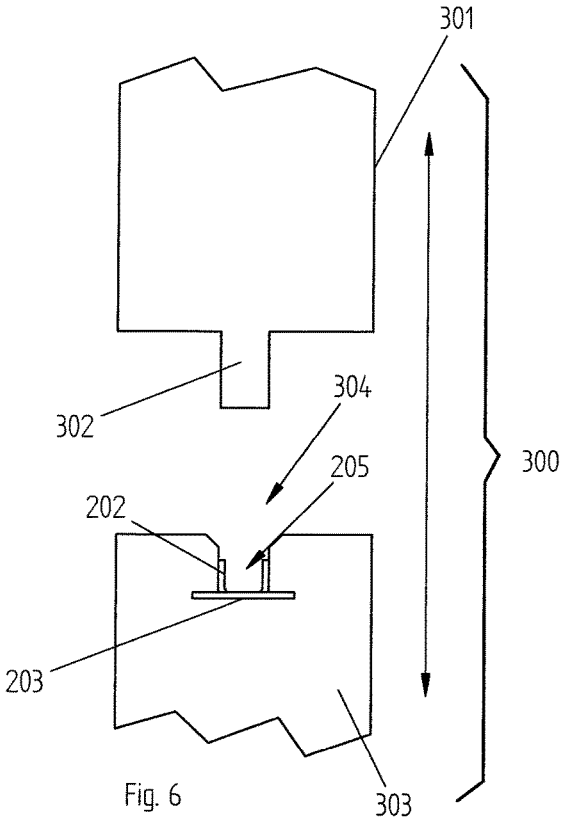
FIGS. 6, 7 and 8 show a device and a first step of the method according to an embodiment of the present invention.

Regarding the method, the step illustrated in Figures from 6 to 8 includes, as shown, the operation of positioning the terminal 200 on the base or support 303 of the device 300, in particular in such a way that the U-shaped portion or crimp 202 of the terminal itself is housed inside the recess 304 in the base 303; obviously, for this purpose, the shape and size of the recess 304 will match those of the U-shaped portion 202, in particular the width of the recess (from left to right in FIG. 6) will be equal to or slightly exceed the width of the U-shaped portion 202. Furthermore, the eyelet 203 will be positioned outside the base or support 303. It should be noted that, according to an embodiment of both the device and the method according to the present invention, the step just described above can be performed automatically, through feed and positioning means not illustrated in the figures. Said feed and positioning means can, for example, be suited to feed a punching and/or cutting and/or bending station both with an intermediate element 100 of the type illustrated in Figures from 1 to 3 and with a simple metal strap, for example by unwinding said element 100 or the strap from a coil, wherein the electrical terminals 200 will be made in said bending and punching station. In the same way, said positioning means are suited to collect the electrical terminals 200 from the bending and punching station and to position them on the base or support 303, as shown in the figures and described above. According to a simplified embodiment of both the method and the device of the present invention, the electrical terminals 200 can be prepared in advance through a separate station and loaded on a feed station that will provide for positioning them on the base or support 303 in an automatic or automated way.

According to a further even more simplified embodiment of the invention, the electrical terminals 200 can, for example, be loaded manually on the support 303. In the successive step of the method according to the embodiment of the present invention shown in Figures from 9 to 11, the end portions **400*t* of the same number of conductors 400, some of which possibly insulated, for example of a winding and in a varying number according to the type of winding, are inserted in the U-shaped portion of the electrical terminal 200 previously positioned on the base or support 303. Also in this case, the insertion of the end portion 400*t* of the conductors 400** in the U-shaped portion can be performed both in a completely automated manner (through suitable means not represented in the figures) and in a semi-automated manner (with the aid of an operator) or manually by an operator.

During the successive step shown in Figures from 12 to 14 at least one element between the press 301 and the base 303 is moved in such a way as to move them near each other, and in particular in such a way as to fit the side walls 206 and 207 of the U-shaped portion of the terminal 200 in the base 303 through the projection 302 of the press 301 as shown in the figures. It should be noted that the method according to the present invention includes also the use of heat for different purposes, one of which is to remove the electrical insulation layer from the end portion **400*t* of the conductors 400. In particular, the generation of heat for the purpose of heating the conductors and the U-shaped portion of the terminal can be performed through means not illustrated in the figures and known to the expert in the art, such as resistances housed in the press 301 and/or in the support 303 or in both of them, and can be started already during the step shown in Figures from 12 to 14 (during which the press 301 and the support 303** are moved near each other) or even in a successive step.

During the successive step of the process or method according to the embodiment illustrated in Figures from 15 to 17, the further approaching movement of the press 301 and the support 303 causes the opposite side walls 206 and 207 of the U-shaped portion to be folded inwards (the outward folding movement being prevented by the side walls of the recess 304), said folding movement being possibly facilitated by the heating of the U-shaped portion and thus in particular of the walls 206 and 207, wherein the removal of the insulating layer will be continued or even completed through the application of heat to the end portion 400*t* of said one or more conductors 400.

During the successive step illustrated in Figures from 18 to 20, the further insertion of the projection 302 of the press 301 in the recess 304 of the support 303 in the presence of heat applied both to the U-shaped portion of the electrical terminal 200 and to the ends 400*t* of the conductors 400 will cause the walls 206 and 207 to be further folded and thus to be compacted on said ends 400*t* in such a way as to obtain both the mechanical connection between the electrical terminal 200 and the conductors 400 and the electrical connection, in consideration of the fact that the end portions 400*t* of the conductors 400 that come into contact with the U-shaped portion of the terminal 200 at this point will be without electrical insulation layer (removed through the application of heat).

At this point, the process has practically been completed, as the electrical terminal 200 is rigidly fixed to the conductors 400.

Figure 21:
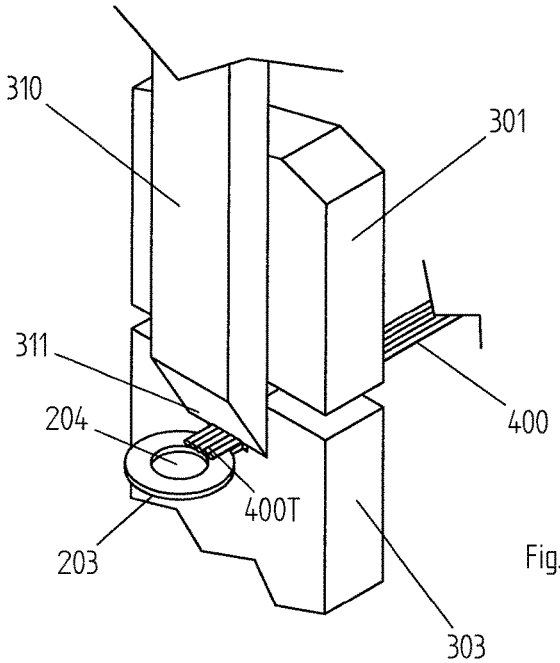
FIG. 21 shows a device and a step of the method according to a further embodiment of the present invention.

FIG. 21 shows an optional step of the method according to an alternative embodiment of the present invention, during which the end portions 400*t* of the conductors 400 that project from the U-shaped portion of the electrical terminal 200 and are not in contact or engaged with the folded side walls 206 and 207 are cut and then removed. Said operation can be performed both automatically and semi-automatically, for example by means of a punch 311 fixed to the press 301 (for example, rigidly or in such a way that it can be translated with respect to the press itself) or alternatively, according to a simpler embodiment of the invention, separately by an operator. In a corresponding way, the device according to the present invention if necessary may comprise the punch 311 and the corresponding translation means.

Figure 23:
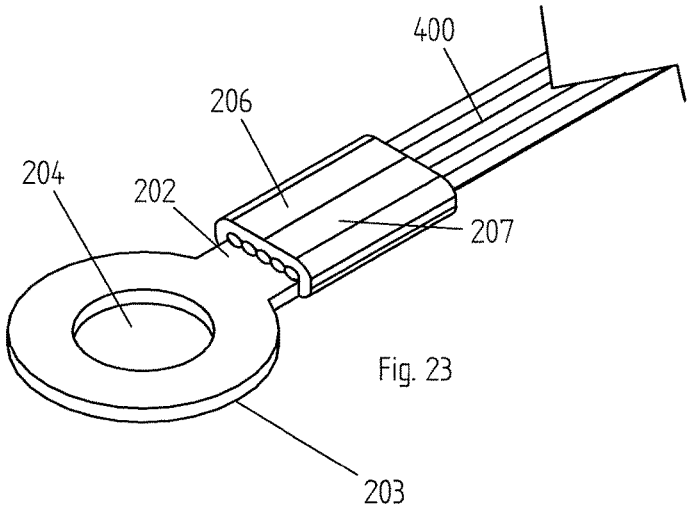

The final result of the method or process is illustrated in FIG. 23, which shows a connection element constituted by an electrical terminal 200 mechanically and electrically connected to the ends of conductors 400.

Figure 24:
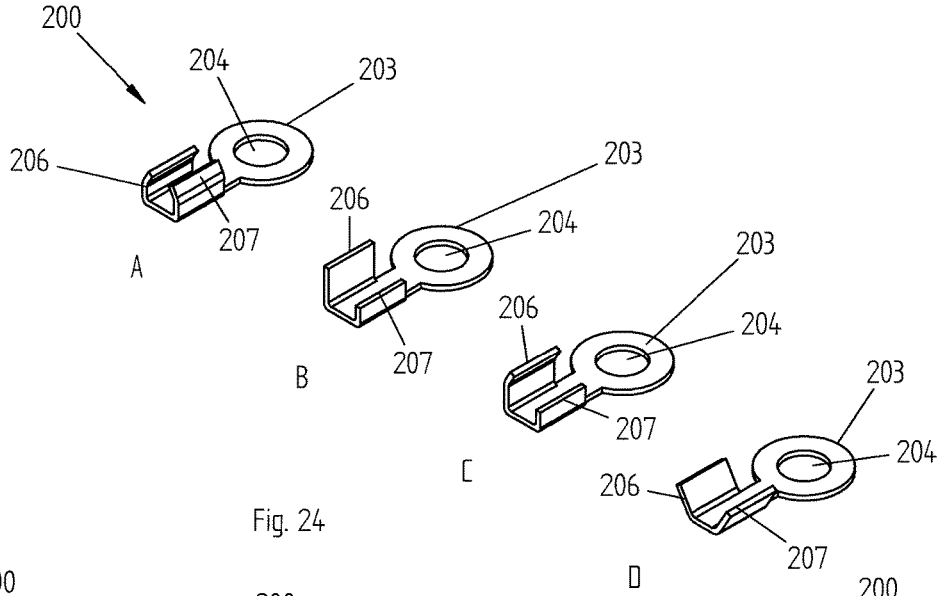
FIGS. 24 and 25 show electrical terminals according to alternative embodiments of the present invention.
Figure 25:
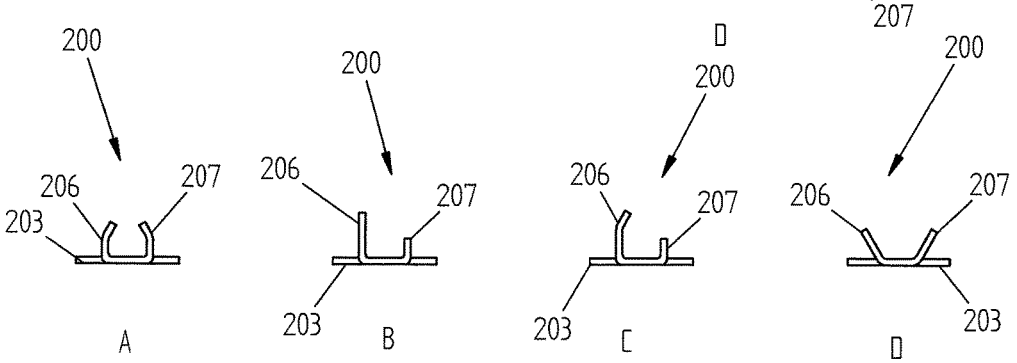

As already explained, FIGS. 24 and 25 show alternative embodiments of the same number of electrical terminals 200 that can be made and/or used according to the present invention. The figures show, in particular, that the opposite walls 206 and 207 can have different shape/or orientation from each other and also from those of the previously described electrical terminal with a precisely U-shaped end portion. FIGS. 24 and 25, in fact, show walls 206 and 207 substantially arranged so as to form a V (FIGS. 24*d* and 25*d*), or even walls in different lengths (FIGS. 24*b* and 25*b* and 24*c* and 25*c*), both of the walls with end portions folded inwards (FIGS. 24*a* and 25*a*), or even the case where only one of the walls has its end portion folded inwards (FIGS. 24*c* and 25*c*).

Figure 7:
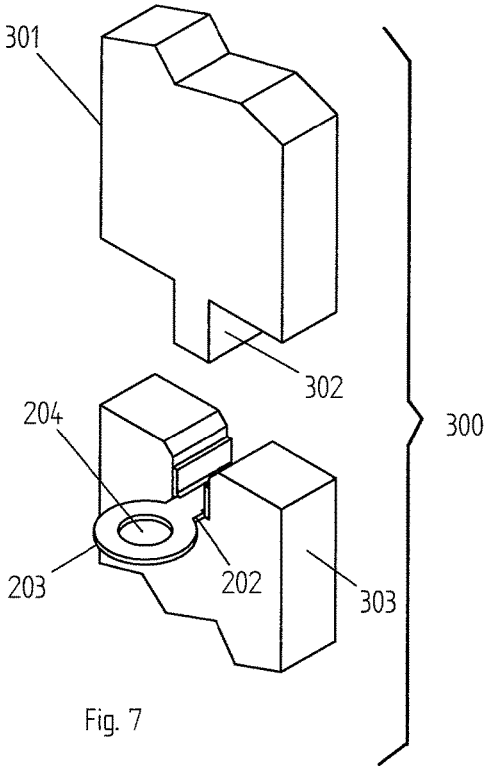
Figure 8:
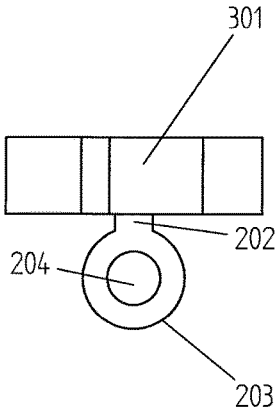
Figure 9:
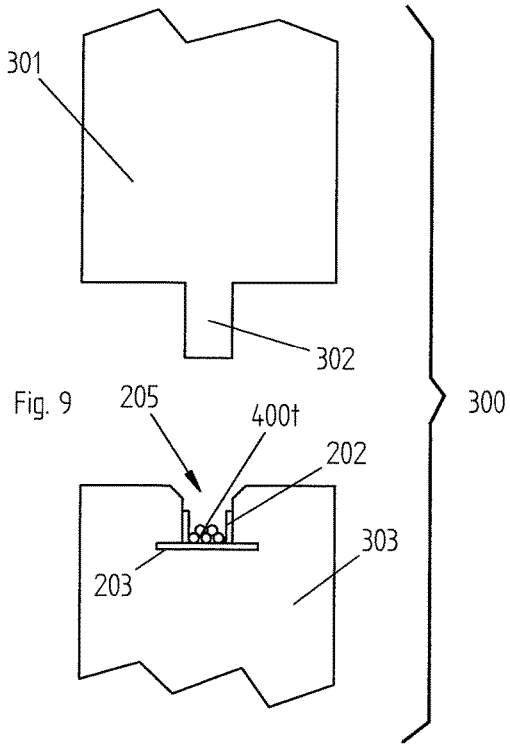
FIGS. 9, 10 and 11 show a device and a further step of the method according to an embodiment of the present invention.
Figure 11:
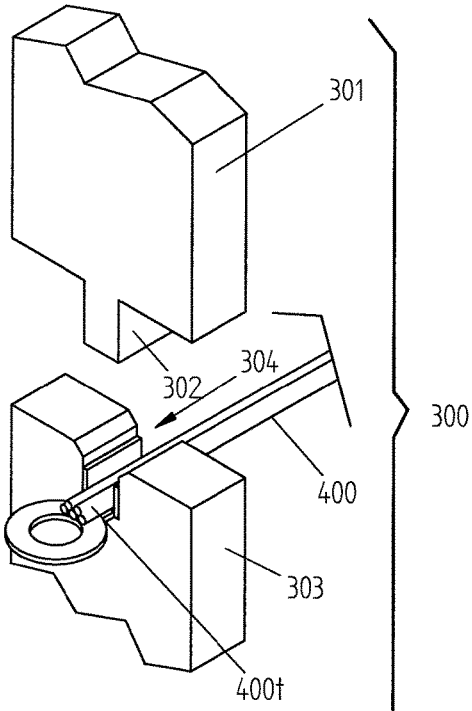
Figure 10:
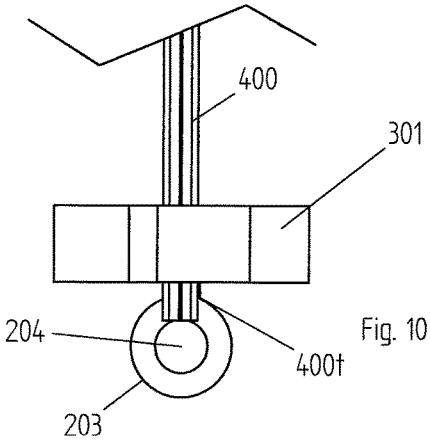
Figure 12:
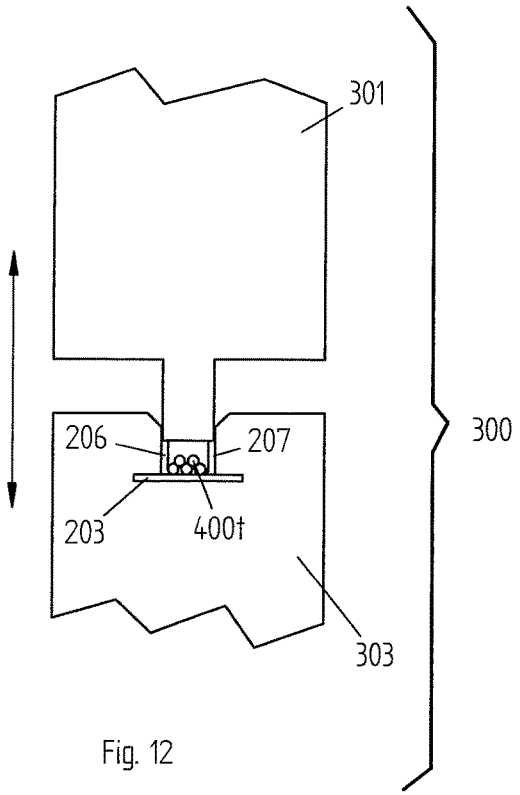
FIGS. 12, 13 and 14 show a device and a further step of the method according to an embodiment of the present invention.
Figure 13:
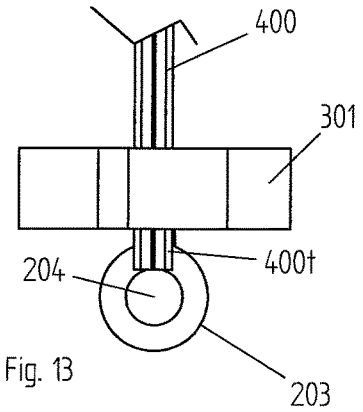
Figure 14:
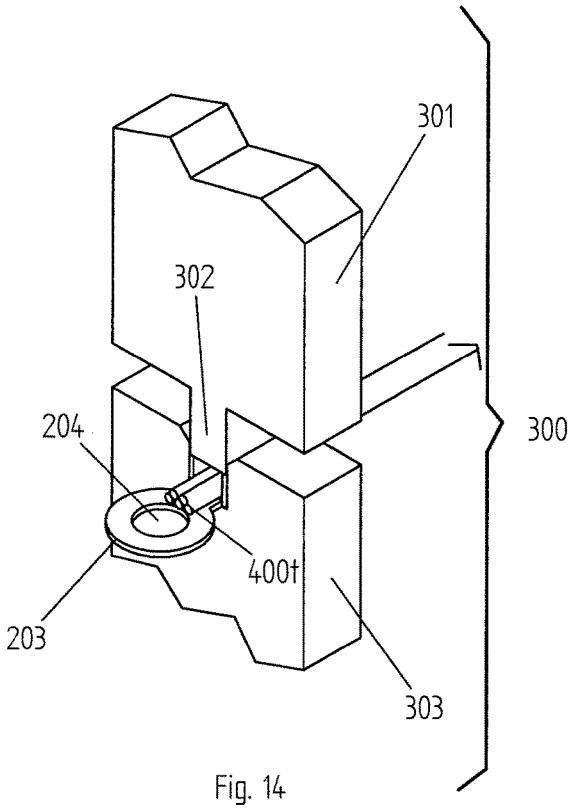
Figure 15:
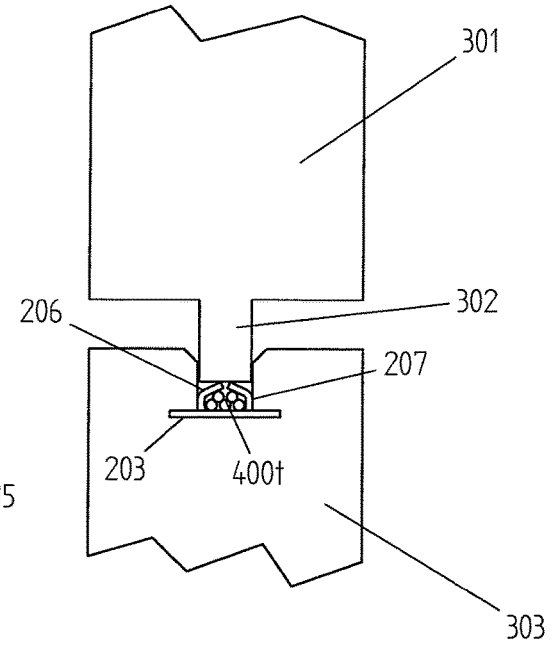
FIGS. 15, 16 and 17 show a device and a further step of the method according to an embodiment of the present invention.
Figure 16:
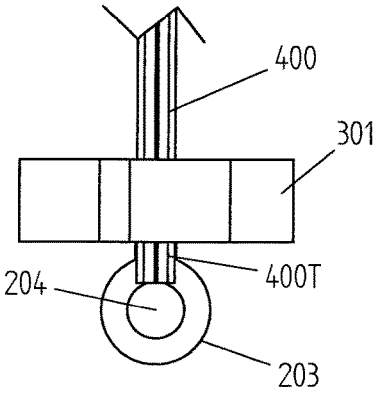
Figure 17:
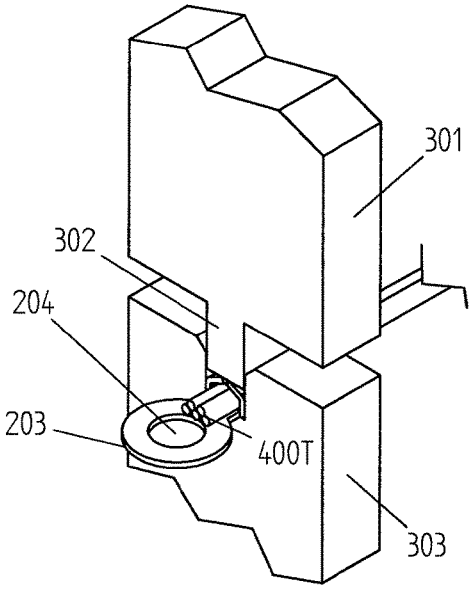
Figure 18:
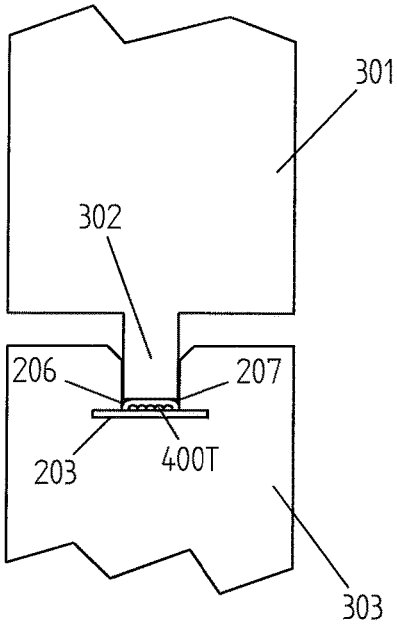
FIGS. 18, 19 and 20 show a device and a further step of the method according to an embodiment of the present invention.
Figure 19:
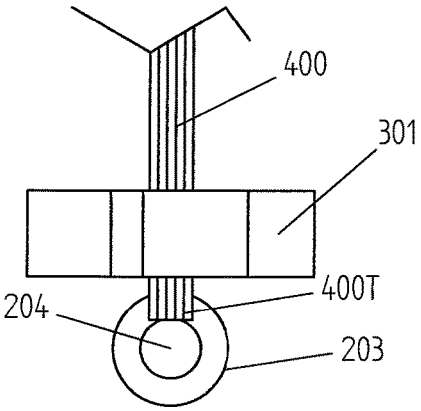
Figure 20:
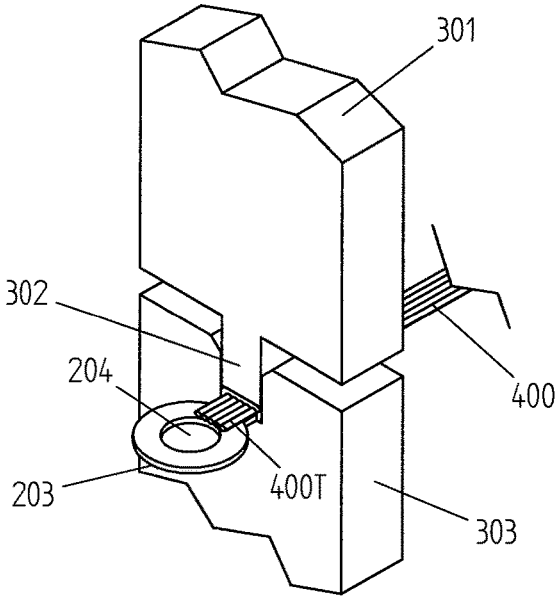
Figure 22:
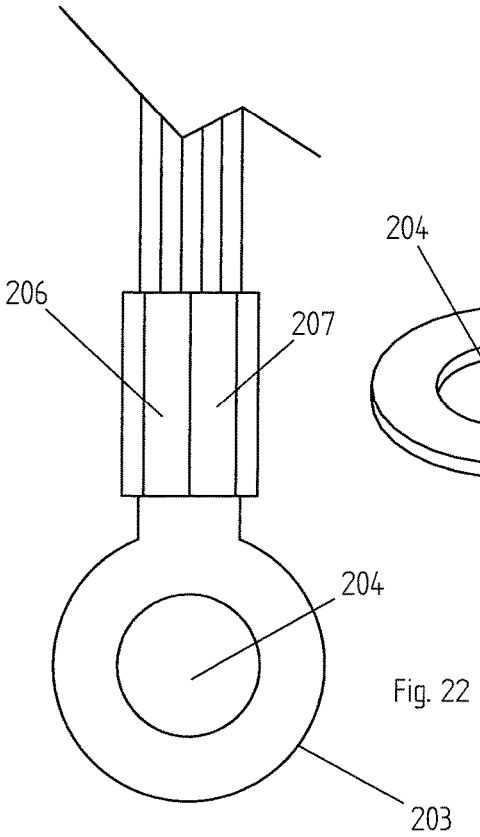
FIGS. 22 and 23 show an electrical terminal carried out through an embodiment of the present invention.
Figure 26:
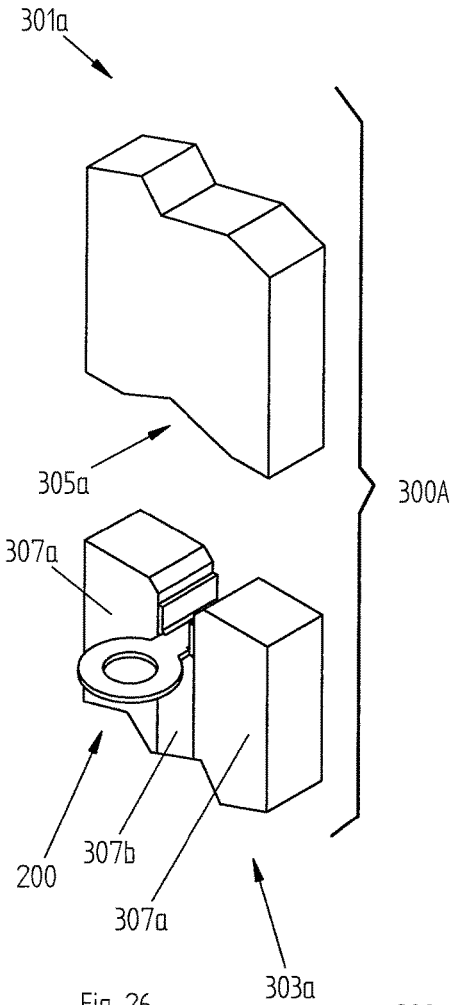
FIG. 26 shows a device and a step of the method according to an embodiment of the present invention.
Figure 27:
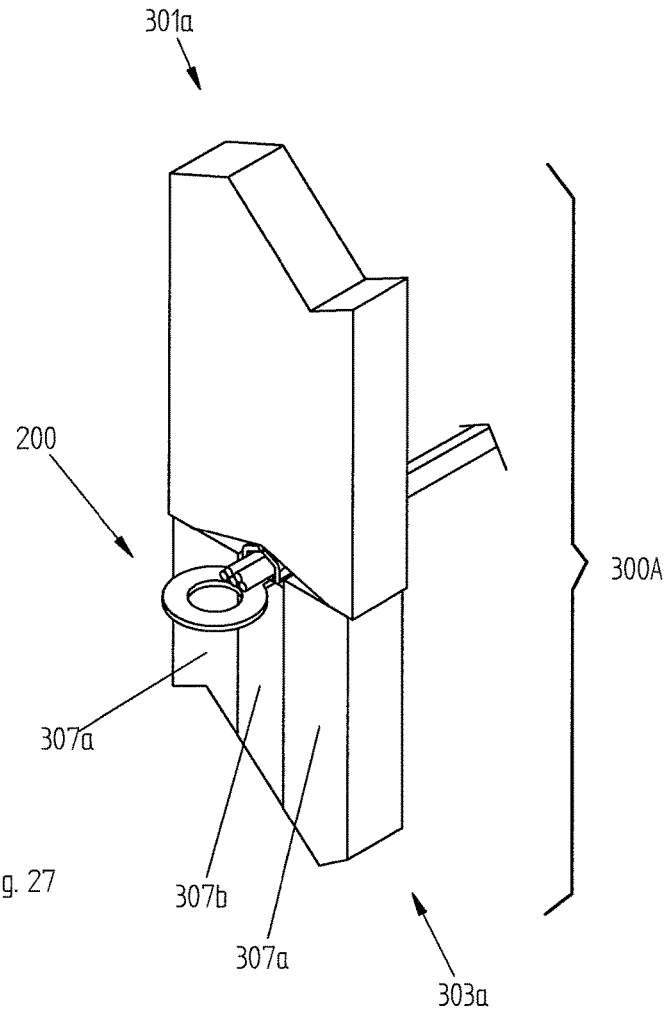
FIG. 27 shows a device and a further step of the method according to an embodiment of the present invention.

FIGS. 26 and 27 schematically show a device according to a further embodiment of the present invention, indicated as a whole by number 300*a*, as well as a first and a second step of the method according to the present invention for the application of an electrical terminal 200 of the type previously described with reference to Figures from 3 to 5 to one or more insulated or not insulated conductors. Also the device 300*a*, analogously to the device shown in FIG. 7, comprises two opposite parts, meaning an element or press 301*a* and a support or mould 303*a*, wherein at least one of the components 301*a* and 303*a* is movable along the directions indicated by the double arrow so that the element 301*a* and the mould or support 303*a* can be moved near each other.

More particularly, in the embodiment illustrated, the support or mould 303*a* is provided with a recess or seat suited to house the electrical terminal 200 and also the element or press 301*a* has a seat or recess 305*a*.

Furthermore, the support or mould 303*a* comprises a first portion 307*a* and a second portion 307*b* that are mutually movable with respect to each other (according to a vertical plane in the example illustrated herein) so that they can be properly configured during the processing steps. More particularly, in a first configuration, shown in FIG. 26, the movable elements 307*a* and 307*b* are arranged in such a way as to create the seat that is suited to house the electrical terminal 200, while in a further configuration, shown in FIG. 27, they are arranged in such a way as to allow the electrical terminal 200 to be fixed to the conductors 400.

Regarding the method, the step illustrated in FIG. 26 includes, as shown, the positioning of the terminal 200 on the base or support 303*a* of the device 300*a*, in particular analogously to that which has been previously described with reference to Figures from 6 to 8 and the following ones.

During a successive step of the process or method according to the embodiment illustrated in FIGS. 26 and 27, the further approaching movement of the press 301*a* and the support 303*a* and the simultaneous lowering of the parts 307*a* and 307*b* causes the opposite side walls 206 and 207 of the U-shaped portion to be folded in a way that is analogous to that previously described with reference to the device 300 (for example, Figures from 12 to 14).

It should be observed that in the solution illustrated in FIGS. 26 and 27, and in particular during the step shown in FIG. 27, the parts 202 of the electrical terminal 200 come into contact with the walls of the seat or recess 305*a* of the element or press 301*a*.

It has thus been shown by means of the previous description of the embodiments of the present invention illustrated in the drawings that the method, the device 300, the electrical terminal 200 and possibly the intermediate element 100 according to the present invention allow the set objects to be achieved; in particular, the advantages obtainable by means of the present invention can be summed up as follows.

The combined application of heat and pressure makes it possible to remove the insulation layer (enamel) from the wires or conductors and to compact the wires in the crimp portion of the electrical terminal, and thus to provide a connection between conductors and terminal that is reliable from both the electrical and the mechanical point of view.

The method allows for a high execution speed, eliminating all the preparatory steps that consist in cutting the wires or conductors, collecting and joining the cable, inserting it in the tubular connector.

The method ensures constant and reproducible results, as the heating is obtained thanks to the passage of a current or the use of ultrasound, which allow accurate control and monitoring of the process to be obtained.

The method guarantees reliability over time, as it guarantees that the connection obtained remains optimal from both the electrical and the mechanical point of view over time and even if the connection is subjected to vibrations.

The method ensures considerable money savings thanks to the elimination of the conductor portion, "CABLE", and of the steps connected to it: cutting to size, stripping and crimping (the conductor portion is uncovered on one side, while the cable terminal is applied to the other side).

The method ensures also energy savings. The elimination of the cable from the electrical circuit makes it possible to reduce the joints and thus to reduce losses in the electrical circuit due to the Joule effect.

The method is particularly flexible and adaptable to the various needs and/or operating conditions, wherein by means of the same device it is possible to make connections even in considerably different sizes, as the space they can occupy inside the winding is not a determining factor any longer, contrary to that which happened with the connections made according to the known art.

Furthermore, the fact that the connection is located near the terminal board or strip eliminates the problem of the insulation of the connection itself, as the successive construction steps of an electrical machine will not affect either the insulation or the connection in any way.

Although the main aspects of the present invention have been illustrated through the above description of the embodiments represented in the drawings, the present invention is not limited to the embodiments described and/or represented herein. On the contrary, all the variants and/or modification of the embodiments described herein that, in the light of the explanation provided above, are clear and immediate for the expert in the art fall within the scope of the present invention. The scope of protection of the present invention is thus defined by the claims.

The invention claimed is:

1. A method for applying an electrical terminal (200) having a housing portion (202) to one or more conductors (400), said one or more conductors having one or more end portions (400*t*) and being equipped with an external electrical insulation layer, said method comprising the following steps:

positioning said electrical terminal (200) in a device (300), the device (300) comprising a mould (303) having a seat (304) suitable for housing the housing portion (202) of said electrical terminal (200), and the device (300) further comprising a press (301); wherein at least one of said mould (303) and of said press (301) is movable toward the other one;

placing the end portions (400*t*) of said one or more conductors (400) in said housing portion (202), said housing portion (202) being channel-shaped with cross section substantially in the shape of a V or a U or a similar shape with two opposite walls (206, 207), said electrical terminal (200) comprising an electrical connection portion (203) that extends from said housing portion (202);

applying heat and pressure so as to compact and/or join said end portions (400*t*) and said housing portion (202) and so as to remove any corresponding electrical insulation layers at least at the level of said housing portion (202), wherein by means of said application of heat and pressure said two opposite walls (206, 207) are closed on said end portions (400*t*), wherein heat is applied by heating at least one of said mould (303) or said press (301).

2. The method according to claim 1, wherein said electrical connection portion (203) comprises an eyelet.

3. The method according to claim 1, wherein said method comprises the formation of said electrical terminal (200) obtained by cutting or punching or bending a continuous metal strap.

4. The method according to claim 3, wherein said metal strap is unwound from a coil.

5. The method according to claim 1, wherein said seat (304) has a shape which matches that of said housing portion (202).

6. The method according to claim 1, wherein said method further comprises the removal of the end portions of said conductors (400) that project from said housing portion (202).

7. A device (300) for applying an electrical terminal (200) having a housing portion (202) to one or more conductors (400), said one or more conductors (400) having one or more end portions (400*t*) and being equipped with an external electrical insulation layer, said device (300) comprising:

a mould (303) having a seat (304) suitable for housing the housing portion (202) of said electrical terminal (200), said housing portion (202) being channel-shaped with cross section substantially in the shape of a U or a V or a similar shape with two opposite walls (206, 207), said electrical terminal (200) comprising an electrical connection portion (203) that extends from said housing portion (202); and a press (301);

wherein at least one of said mould (303) and of said press (301) is movable toward the other one;

wherein at least one of said mould (303) and of said press (301) is suited for applying heat and pressure so as to compact or join said end portions (400*t*) and said housing portion (202) and so as to remove the corresponding electrical insulation layers at least at the level of said housing portion (202), so as to cause said opposite walls (206, 207) to close on said end portions (400*t*).

8. The device (300) according to claim 7, wherein said device (300) furthermore comprises a forming device suitable for the formation of said electrical terminal (200) by cutting or punching or bending a continuous metal strap.

9. The device (300) according to claim 8, wherein said device (300) furthermore comprises an unwinding device for unwinding said metal strap from a coil.

10. The device (300) according to claim 7, wherein said seat (304) has a shape that matches the U or V or similar shape of said housing portion (202).

11. The device (300) according to claim 7, wherein said device (300) furthermore comprises a removing device (311) suitable for removing the end portions (400*t*) of said one or more conductors (400) that project from said U-shaped or V-shaped or similar portion of said electrical terminal (200).

* * * * *